United States Patent [19]

Kido et al.

[11] 4,025,345

[45] May 24, 1977

[54] METHOD OF PREPARING BLEACHED PHASE HOLOGRAM AND A BLEACHING SOLUTION COMPOSITION THEREFOR

[75] Inventors: Keishiro Kido; Noboru Arai, both of Asaki, Japan

[73] Assignee: Fuji Photo Film Co., Ltd., Minami-ashigara, Japan

[22] Filed: Aug. 25, 1975

[21] Appl. No.: 607,520

[30] Foreign Application Priority Data

Aug. 23, 1974 Japan ..... 49-97444

[52] U.S. Cl. ..... 96/60 R; 96/27 H

[51] Int. Cl.[2] ..... G03C 5/32; G03C 5/04

[58] Field of Search ..... 96/60 R, 27 H

[56] References Cited

UNITED STATES PATENTS

| | | | |
|---|---|---|---|
| 1,508,089 | 9/1924 | de Sperati | 96/60 R |
| 2,019,718 | 11/1935 | Mannes et al. | 96/60 R |
| 2,100,594 | 11/1937 | Heymer | 96/60 R |
| 2,108,261 | 2/1938 | Jamieson | 96/60 R |
| 2,141,354 | 12/1938 | Gundelfinger | 96/60 R |
| 2,206,190 | 7/1940 | Jamieson | 96/60 R |
| 2,467,359 | 4/1949 | Rubinstein | 96/60 R |

OTHER PUBLICATIONS

T881,006, Dec. 1970, Bard, 96/60 R.

Appld. Optics, vol. 8, No. 1, Jan. 1969, pp. 85–89, Upatnieks & Leonard.

Appld. Optics, vol. 9, No. 6, June 1970, pp. 1363–1368, McMahon & Maloney.

Optik, vol. 38, No. 2, Jan. 1973, pp. 156–168, by van Renesse & Bouts.

Fujitsu Scientific Technical Journal, Mar. 1974, pp. 135–155, by Inagaki, Nakajima & Nishimura.

Hackh's Chemical Dictionary, 3rd Ed. p. 858.

*Primary Examiner*—Mary F. Kelley

*Attorney, Agent, or Firm*—Sughrue, Rothwell, Mion, Zinn & Macpeak

[57] ABSTRACT

A method of preparing a bleached phase hologram comprising bleaching a silver image of an amplitude hologram formed in a silver halide photographic material with a bleaching solution comprising a liquid medium capable of swelling the gelatin and/or modified gelatin hydrophilic colloid of the silver halide photographic material to an extent of from about 150 to 400% and containing iodine, so as to bleach the silver image by the reaction of the iodine with the silver and the silver image of the amplitude hologram is formed by exposing a silver halide photographic material so as to form a hologram and development and fixing processing the exposed silver halide photographic material.

6 Claims, 1 Drawing Figure

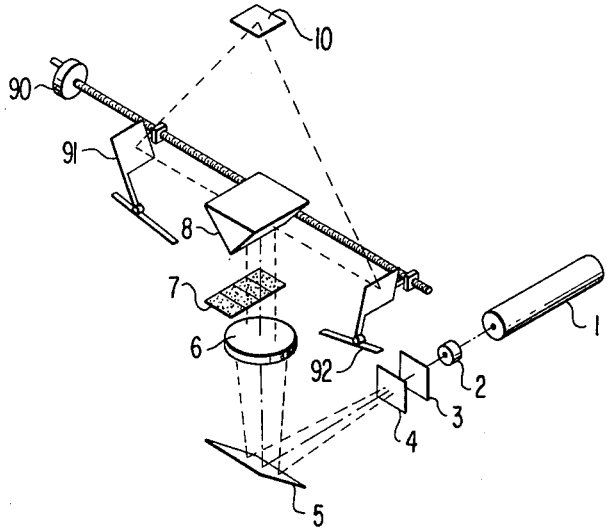
10
90
91
8
7
6
92
1
2
3
4
5

METHOD OF PREPARING BLEACHED PHASE HOLOGRAM AND A BLEACHING SOLUTION COMPOSITION THEREFOR

BACKGROUND OF THE INVENTION

1. Field of the Invention

This invention relates to a method of preparing a bleached phase hologram and a bleaching composition used in the method.

2. Description of the Prior Art

Various photosensitive materials are known which can be used in holography, including silver halide photographic materials such as those based on silver halides, dichromated gelatin, or photopolymerizable materials. Of these materials silver halide photographic materials are most widely used because of their high photographic speed, their senstivity to a broad range of spectral wavelengths and the capability of producing holograms with a very high diffraction efficiency.

In order to prepare a hologram by using a silver halide photographic material, the material is exposed to an interference beam formed by superimposing an object beam with a reference beam, each beam from a laser. Then the exposed material is developed and fixed to form an amplitude hologram based on the developed silver. Since such an amplitude hologram has a low diffraction efficiency, theoretically predicted to be around 7%, the amplitude hologram is usually further processed, i.e., bleached (rendered transparent) to be converted into a phase hologram, which is practically used. Various bleaching compositions for amplitude holograms have been reported, for example, in Applied Optics, 8, 88 (1969) and ibid. 9, 1367 (1970), however, none of these known compositions satisfy all of the requirements for holograms, (i) diffraction efficiency, (ii) stability to light, (iii) light scattering property, (iv) light absorption, (v) spacial frequency, etc. Since a bleached phase hologram essentially has a high diffraction efficiency, the urgent problem is how to improve the stability to light. Of conventional methods of preparing a bleached phase hologram, a most preferably method from the standpoint of stability to light comprises bleaching an amplitude hologram in any conventional known manner as disclosed in the above references, and then immersing the bleached hologram into an aqueous potassium iodide solution so as to convert the relatively unstable silver compound which has been formed by the bleaching and is readily decomposable by light into a fairly stable silver iodide. Although this method can certainly be used to produce a better hologram with an improved stability to light than other known methods, impurities still tend to be formed and remain in the hologram because a complete conversion of the unstable silver compound into silver iodide is impossible using this method. These impurities function as nuclei for printing out of silver, thus promoting the darkening of the hologram upon exposure to light. Another drawback of the above-cited method is the crystal growth accompanying the conversion of silver compounds into silver iodide, which increases the light scattering of the resulting hologram.

SUMMARY OF THE INVENTION

Extensive research has now been carried out in order to solve these drawbacks of bleached holograms prepared using the above conventional methods and the present invention described hereinafter which enables the production of bleached phase holograms with unexpected properties has been developed.

The present invention in one embodiment comprises a method of preparing a bleached phase hologram comprising contacting a silver image constituting an amplitude hologram formed in a silver halide photographic material with a bleaching solution containing iodine ($I_2$) so as to bleach the silver image by the reaction of the iodine with the silver.

In another embodiment, this invention provides a bleaching composition for use in the method of preparing a bleached phase hologram of this invention described above which comprises iodine ($I_2$) and a liquid medium capable of swelling the gelatin and modified gelatin, such as phthalated gelatin used as the binder for the hologram layer of the amplitude holographic material, to about 150 to about 400% by volume such that the bleaching solution permeates into the hologram recording layer and at the same time reduces the light scattering property of the silver iodide crystalline particles formed in the recording layer as the result of the reaction of the silver image with the iodine.

BRIEF DESCRIPTION OF THE DRAWING

The FIGURE illustrates an optical system for the preparation of an amplitude hologram, in which 1 is a laser beam generation source, 2 a condenser lens, 3 a pinhole, 4 a shutter, 5 a reflection mirror, 6 a collimator lens, 7 an optical wedge, 8 a splitting mirror, 90 a special frequency dial, 91 and 92 each a reflective mirror, and 10 an exposure mount, respectively.

DETAILED DESCRIPTION OF THE INVENTION

An amplitude hologram processed by the method of the present invention is prepared by projecting a laser beam onto a silver halide photographic material with the use of an optical system, e.g., as shown in the drawing and processing the exposed material in a conventional manner, i.e., using development, fixing and washing steps.

The silver halide photographic material used in the present invention fundamentally comprises a transparent support having thereon a silver halide emulsion layer. If necessary, at least one subbing layer can be interposed between the transparent support and the silver halide emulsion layer.

The transparent support designates a glass plate, quartz, sapphire, plastic film (e.g., a cellulose acetate film, a cellulose nitrate film, a polyethylene terephthalate film, a polystyrene film, heat resistive high melting polymer such as poly(pyromellitic acid-p-phenylenediamineimide), poly(p-oxybenzoate), poly-(ethylene-2,6-naphthalate), polyamidoimide polymers as described in U.S. Pat. No. 3,554,984, polyimidoimine polymers as described in U.S. Pat. No. 3,472,815, etc.), and the like.

The support must be transparent since transparency is a necessary condition for hologram recording as is well known in the holographic art. However, the transparent support is not particularly limited in the present invention with respect to its other characteristics.

The term "transparent support" as used herein designates a support which comprises a substance capable of transmitting not less than 50%, preferably not less than 70%, of electromagnetic waves in the near-ultraviolet (e.g., about 3000 A to 4000 A) and visible light regions (e.g., about 4500 A to 7000 A).

The subbing layer to be used is a layer which intimately adheres to both the transparent support and the silver halide emulsion layer. Where the transparent support is extremely different in property from the silver halide emulsion layer, two or more subbing layers can be employed. More specifically, those subbing layers described in Japanese Patent Publiciation Nos. 5509/64, 2597/69, 11616/71, U.S. Pat. No. 3,492,122, West German Patent Application (OLS) No. 2,001,727, etc., are suitable. Also, a subbing layer formed by providing a thin polyvinyl acetate layer (for example, a thickness of about 0.1 to 0.3 $\mu$) and bringing the surface into contact with an alkaline aqueous solution such as an aqueous solution of sodium hydroxide for saponification can be used. A suitable thickness for the subbing layer can range from about 0.1 to 0.5 $\mu$.

The silver halide emulsion can be obtained by dispersing silver halide in a water-soluble binder. Illustrative silver halides are silver chloride, silver bromide, silver iodide, silver chlorobromide, silver bromoiodide, silver chlorobromoiodide, etc. A most typical silver halide emulsion is an emulsion which contains about 90 mol % of more silver bromide (preferably containing not more than about 5 mol % silver iodide) and contains silver halide grains of a mean grain size of not more than about 0.1 $\mu$ (a so-called Lippmann emulsion), and in which the weight ratio of silver halide to the water-soluble binder is about 1:4 to about 6:1. Another example of a silver halide emulsion is an emulsion which contains about 50 mol % or more (preferably 70 mol %) silver chloride and contains silver halide grains of a mean grain size of not more than about 1.0 $\mu$.

On the other hand, examples of water-soluble binders include gelatin and modified gelatin. If desired, a mixture of two or more of these binders can be used. Gelatin and/or modified gelatin can be replaced, partly by a synthetic high molecular weight substance. The modified gelatin includes a so-called gelatin derivative (prepared by processing gelatin with a compound having a group capable of reacting with the functional groups contained in the gelatin molecule (i.e., amino groups, imino groups, hydroxy groups or carboxy groups)) or by a graft polymer prepared by grafting a molecular chain of other high molecular weight substances. Suitable compounds for preparing the gelatin derivatives, e.g., isocyanates, acid chlorides, and acid anhydrides as described in U.S. Pat. No. 2,614,928 acid anhydrides as described in U.S. Pat. No. 3,118,766, bromoacetic acid as described in Japanese Patent Publication No. 5514/64, phenyl glycidyl ethers as described in Japanese Patent Publication No. 21845/67, vinyl sulfone compounds as described in U.S. Pat. No. 3,132,945, N-allylvinylsulfonamides as described in British Pat. No. 861,414, maleinimide compounds as described in U.S. Pat. No. 3,186,846, acrylontriles as described in U.S. Pat. No. 2,594,293, polyalkylene oxides as described in U.S. Patent 3,312,553, epoxy compounds as described in Japanese Pat. Publication No. 26845/67, acid esters as described in U.S. Pat. No. 2,763,639, alkanesultones as described in British Pat. No. 1,033,189, and the like. Descriptions of suitable branch high polymers to be grafted on gelatin are given in U.S. Pat. No. 2,763,625, 2,831,767, 2,956,884, Polymer Letters, 5, 595 (1967), Phot. Sci. Eng., 9, 148 (1965), J. Polymer Sci. A-1, 9, 3199 (1971), and the like.

These silver halide emulsions are advantageously optically sensitized with known optical sensitizers such as the cyanine dyes and merocyanine dyes as described in U.S. Pat. Nos. 1,346,301, 1,846,302, 1,942,854, 1,990,507, 2,493,747, 2,739,964, 2,493,748, 2,503,776, 2,519,001, 2,666,761, 2,734,900, 2,739,149, and British Pat. No. 450,958.

The emulsion is advantageously chemically sensitized with salts of noble metals such as ruthenium, rhodium, palladium, iridium, platinum, etc., as described in U.S. Pat. Nos. 2,448,060, 2,566,245, and 2,566,263. Also, the emulsion can be chemically sensitized with a gold salt as described in U.S. Pat. No. 2,339,083. The emulsion can be fog-inhibited and stabilized with gold metal as described in U.S. Pat. Nos. 2,597,856 and 2,597,915. Furthermore, a thiopolymer as described in U.S. Pat. 3,046,129 can advantageously be incorporated in the emulsion. In addition, the emulsion can be fog-inhibited with mercury compounds as described in U.S. Pat. No. 3,046,129, column 20, line 51 to column 21, line 3, triazoles, azaindenes, disulfides, quaternary benzothiazolium compounds, zinc salts and cadmium salts.

The emulsion can contain light-absorbing dyes as described in U.S. Pat. Nos. 2,527,583, 2,611,696, 3,247,127, 3,260,601, etc.

The emulsion is advantageously hardened with a suitable hardening agent for gelatin and/or modified gelatin hydrophilic colloids, such as formaldehyde or a like hardener; N-methylol compounds as described in U.S. Pat. Nos. 2,732,316 and 2,586,168; carbodiimide compounds as described in U.S. Pat. No. 3,100,704; epoxy compounds as described in U.S. Pat. No. 3,091,537; halogensubstituted fatty acids (e.g., mucobromic acid, etc.); compounds having many acid anhydride groups; methanesulfonic acid bisester; dialdehydes or the sodium bisulfite adducts thereof such as $\beta$-methylglutaraldehyde bissodium bisulfite; bisaziridinecarboxamide (e.g., trimethylenebis(1-aziridinecarboxyamide)); triazine derivatives (e.g., 2-hydroxy-4,6-dichloro-s-triazine, etc.); and the like.

The silver halide emulsion is coated on a transparent support or after adding a coating aid as described in U.S. Pat. No. 3,046,129. The silver halide emulsion layer can have a thickness of about 1 $\mu$ or above and preferably has a thickness ranging from 3 $\mu$ to 30 $\mu$ and can be coated in one or more layers on the support.

If desired, a backing layer, an antihalation layer, an interlayer, an uppermost layer (e.g. a protective layer, etc.), and the like can be provided on the support or on the emulsion layer.

Suitable exposures of the silver halide emulsion can be electromagnetic radiation from the laser, to which the silver halide emulsion is sensitive, e.g., visible, ultraviolet, infrared. With the optically sensitized photographic lightsensitive materials, it is convenient to select light mainly having a wavelength corresponding to optically sensitized region of the emulsion as the light for exposing the emulsion layer.

In the drawing, 1 is a laser beam generating means, and along the advancing path of the laser beam from 1 are located, in turn, a condenser lens 2, a pinhole filter 3 and a shutter 4. After passing these units, the direction of the laser beam is changed by means of a reflection mirror 5 and the laser beam enters a collimator lens 6 whereby the incident beam is converged into a parallel one. The parallel beam, after passing through an optical wedge 7, is reflected by a beam splitting mirror 8 into two beams, each is reflected by a mirror 91 or 92 which is linked with a spacial frequency dial 90 and then impinges on a photographic material placed on an exposure mount 10 whereby an interference image is focused on the photographic material. These techniques are described in U.S. Pat. No. 3,580,655.

Formation of a silver image in the silver halide emulsion layer can be effected using conventional photographic processings, that is, by development-processing the exposed emulsion layer and, if necessary, fixing. Conventional photographic processings including exposure, development, fixing, etc., which can be used are described in detail in "Techniques of Microphotography" Kodak Data Book P-52.

Developing agents, which can be used in the method of the present invention for forming silver images, are those well known in the art, and include developing agents such as the dihydroxybenzenes (e.g., hydroquinone, chlorohydroquinone, bromohydroquinone, isopropylhydroquinone, toluhydroquinone, methylhydroquinone, 2,3-dichlorohydroquinone, 2,5-dimethylhydroquinone, etc.), the 3-pyrazolidones (e.g. 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.) the aminophenols (e.g., o-aminophenol, p-aminophenol, N-methyl-o-aminophenol, N-methyl-p-aminophenol, 2,4-diaminophenol, etc.), pyrogallol, ascorbic acid, the 1-aryl-3-aminopyrazolines (e.g., 1-(p-hydroxyphenyl)3-aminopyrazoline, 1-(p-methylaminophenyl)-3-pyrazoline, 1-(p-aminophenyl)-3-pyrazoline, 1-(p-amino-m-methylphenyl)-3aminopyrazoline, etc.), and mixtures thereof. The developer generally posseses a pH of not less than about 8, preferably about 8.5 to 12.5.

The developer can contain, if desired, a preservative (e.g., a sulfite a bisulfite, etc.), a buffer (e.g., a carbonate, boric acid, borate, an alkanolamine, etc.), a dissolving aid (e.g., polyethylene glycol, etc.), a pH-adjusting agent (e.g., acetic acid or a like organic acid, etc.), a sensitizing agent (e.g., a quaternary ammonium salt, etc.), a development accelerator, a surface active agent, etc.

On the other hand, suitable fixing agents for the silver halide are the generally well known solvents for silver halide, such as a water-soluble thiosulfate (e.g., potassium thiosulfate, sodium thiosulfate, ammonium thiosulfate, etc.) a water-soluble thiocyanate (e.g., potassium thiocyanate, sodium thiocyanate, ammonium thiocyanate, etc.), a water-soluble organic diol (e.g., 3-thia-1,5-pentanediol, 3,6-dithia-1,8-octandiol, 3,6,9-trithia-1,11-undecanediol, 3,6,9,12-tetrathia1,14-tetradecanediol, etc.). a water-soluble sulfur-containing organic dibasic acid (e.g. ethylenebisthioglycolic acid, etc.), a water-soluble salt thereof (e.g., sodium ethylenebisthioglycolate and potassium ethylenebisthioglycolate), and a mixture thereof.

The fixing agent-containing solution can contain, if desired, a preservative (e.g., a sulfate, a bisulfate, etc.), a pH-buffer (e.g., boric acid, a borate, etc.). a pH-adjusting agent (e.g., acetic acid, etc.), a chelating agent and the like.

The amplitude hologram thus-prepared comprises a holographic silver image formed in the photosensitive layer (hereinafter referred to as a "hologram layer") on the substrate. Such a hologram layer is expected to provide a silver image with high contrast. Such an image has, in other words, a high degree of modulation and a high saturation density. To achieve this characteristic, the thickness of the hologram layer must be taken into account, and generally speaking, a thicker layer is preferred. Of course, the holographic images should be recorded in the hologram layer is faithfully as possible. Where the hologram layer comprises a silver halide photographic material, however, the level of fidelity tends to deteriorate since the configuration of the originally formed latent image is modified during the various processings such as development, fixing and bleaching to which the material must be subjected until a phase hologram is formed therein, especially when silver halide is developed to silver and when the silver image is bleached to a silver compound. The degree of this change in configuration depends on the extent the binder is swelled during processing and also on the reaction kinetics involved, both of which must therefore by suitably regulated.

Thus in the present invention the bleaching solution to bleach the silver image of an amplitude hologram characteristically comprises iodine and a liquid medium comprising water and an organic liquid capable of swelling the gelatin or gelatins of the hologram layer to a desirable extent and also dissolving iodine. The water in the liquid medium serves to swell the hologram layer, and the organic liquid serves not only to dissolve the iodine, but also to prevent the hologram layer from excessively swelling. Accordingly the ratio of the water and the organic liquid which is suitable is that which gives a desirable extent, i.e., of 150 to 400% by volume, of swelling of the hologram layer. The ratio of the organic liquid to the water, in general, is within about 2 to about 10 parts by volume of the organic liquid based on one part by volume of water. The iodine can be dissolved in the resulting mixture. Alternatively, the iodine can be dissolved in a single organic liquid followed by subsequent dilution. Suitable organic liquids capable of dissolving iodine include alcohols such as methanol, ethanol, isopropanol, ethylene glycol, glycerol, etc., aromatic hydrocarbons such as benzene, toluene, xylene, mesitylene, etc., halogenated aliphatic hydrocarbons such as ethyl bromide, ethylene bromide, ethylene chloride, tirchloroethylene, bromoform, chloroform, carbon tetrachloride, etc., esters such as ethyl acetate, methyl acetate, etc., ethers such as diethyl ether, etc., aliphatic hydrocarbons (including alicyclic hydrocarbons such as heptane, cyclohexane, isooctane, etc., ketones such as acetone, methyl ethyl ketone, diethyl ketone, etc. The concentration of the iodine in the liquid medium can range from about 0.01% by weight up to a saturated solution.

A suitable bleaching solution composition for a hologram layer based on gelatin as the binder is set forth below.

| Component | | Amount |
|---|---|---|
| Liquid Medium | Organic Liquid | 100 ml |
| | Water | about 10 to 40 ml |
| Iodine | | about 100 to 500 mg |

The bleaching solution of this invention can contain, if desired, a surface active agent (e.g. polyethylene glycol, a sorbitan fatty acid ester, etc.), a pH adjusting agent (e.g, acetic acid or a like organic acid, a quaternary ammonium hydroxide or salt, etc.), a hardening agent, e.g., as hereinbefore described as a hardening agent for gelatin and/or modified gelatin hydrophilic colloids, and the like.

The bleaching temperature of the hologram layer using the bleaching solution of this invention generally ranges from about 10° C to 50° C, preferably 17° C to 32° C. The bleaching time generally ranges from about 4 minutes to 30 minutes, preferably from 5 minutes to 10 minutes.

It should be emphasized, as shown above, that the liquid medium selection is quite important in formulating the bleaching composition. Further, in the present invention, the extent of swelling of the binder of an amplitude hologram layer to be processed is controlled so as to allow the bleaching solution to permeate into the hologram layer and simultaneously to sufficiently suppress the light scattering of the silver iodide crystalline particles resulting from the reaction between the silver image and the iodine. Usually the desirable range of the degree of swelling of gelatin hydrophilic colloids by the bleaching solution is from about 150 to 400%, more preferably from about 200 to 300% by volume. A degree of swelling higher than about 4005 causes the silver iodide formed by the iodidization of the silver image to grow to coarse, thus producing a hologram with an undesirably high light scattering property. Bleaching solutions conventionally used comprising water, which permits the dry gelatin of the hologram layer to swell to more than ten times in volume, have been observed to give rise to silver iodide crystals having a spongy structure with an extremely high light scattering property. Thus, in the present invention, the bleaching solution is formulated so as to suppress the swelling of the binder in the hologram layer only to the extent necessary and to minimize the size of the silver iodide crystals formed.

The bleached phase hologram provided according to the present invention has a characteristically superior light stability as well as a high diffraction efficiency to those prepared by other bleaching solutions, since the hologram is prepared from an amplitude hologram produced by any of the known, conventional methods using a bleaching solution comprising iodine and a carefully designed composition. While not desiring to be bound, these advantageous features of the phase hologram prepared according to the present invention are believed to be attributable to following factors. Basically silver iodide has a very low sensitivity to light and a hologram layer containing silver iodide is quite stable to light. In the case of a phase hologram prepared by the method of the present invention, the bleaching processing is carried out along with an effective suppression of the degree of swelling of the hologram layer, the silver iodide crystals are allowed to grow rather slowly over a comparatively prolonged bleaching period, and the image forming silver is completely bleached. Thus, silver iodide particles of good crystallinity and also substantially free from impurities are produced and therefrom printing out of silver does not occur due to impurities. For example, light radiation at an intensity of 150,000 luxes at the sample surface using a 150 watt high pressure mercury lamp in several minutes gives rise to a noticiable darkening of a hologram prepared using any of the conventionally known bleaching solutions (such as those based on ferricyanide, chromium or mercury chloride) and by a subsequent treatment with a potassium iodide solution. On the contrary, the hologram prepared with a bleaching solution of the present invention comprising iodine and a water-organic liquid system does not show any tendency toward darkening even after several hours of the same radiation and in addition no deterioration in diffraction efficiency at all is observed. These marked differences with respect to light stability between holograms prepared by conventional bleaching methods and a hologram prepared by the present invention may perhaps be ascribed to various factors including the purity and the perfectness of the crystallinity of the compound formed in the gelatin layer by bleaching and the environmental conditions surrounding the crystals (whether iodine does or does not remain in the gelatin).

The present invention will hereinafter be described in detail with reference to some specific examples. Unless otherwise indicated herein, all parts, percents, ratios and the like are by weight.

EXAMPLE 1

1400 m*l* of a silver bromide emulsion (mean grain size of silver bromide: about 0.6 $\mu$m) was prepared using 50 g of gelatin and 188 g of silver bromide. Then, this emulsion was subjected to physical ripening, and after adding sodium thiosulfate and chloroauric acid ($HAuCl_4$), subjected to chemical ripening in a usual manner. To this emulsion was added 0.15 g of 5-[2-(3-methylthiazolinylidene)ethylidene]-3-carboxymethylrhodanine to optically sensitize the emulsion to light of a wavelength of 510 nm – 560 nm. Then, the emulsion was coated in a thickness of about 6 $\mu$m on a glass plate, and then dried to obtain an ultrafine grain photographic light-sensitive plate.

Holographic images were exposed on this photographic light-sensitive plate with the use of an optical system such as illustrated in the drawing. Then, the exposed plate was development-processed in a developer having the following composition (24° C, 5 min.), followed by fixing in a fixing solution (24° C, 1 min.) and washing with water to obtain a silver halographic image.

| | | |
|---|---|---|
| Developer | | |
| 1-Phenyl-3-pyrazolidone | 0.5 | g |
| Sodium Sulfite | 50 | g |
| Hydroquinone | 12 | g |
| Sodium Carbonate (monohydrate) | 60 | g |
| Potassium Bromide | 2 | g |
| Benzotriazole | 0.2 | g |
| 1-Phenylmercaptotetrazole | 5 | mg |
| Phenazine-2-carboxylic Acid | 1 | g |
| Water to make | 1 | l |
| Fixing Solution | | |
| Ammonium Thiosulfate (70% aq. soln.) | 200 | ml |
| Sodium Sulfite | 15 | g |
| Boric Acid | 8 | g |
| Glacial Acetic Acid | 16 | ml |
| Ammonium Sulfate | 10 | g |
| Sulfuric Acid | 2 | ml |
| Water to make | 1 | l |

The dried plates were bleached with a solution having the following composition at 24° C for 5 to 40 minutes, respectively.

| | |
|---|---|
| Ethyl Alcohol | 100 ml |
| Iodine | 100 mg |
| Distilled Water | 25 ml |

As a result of repeating the above on various samples, the time required to render the silver image of the photographic materials transparent by bleaching was demonstrated to change depending on the optical density of the developed silver constituting the amplitude hologram, and that an almost proportional relationship was observed between the time required and the density. That is, an image with an optical density of from 0.5 to 4.0 was bleached in from about 5 to 40 minutes. The resulting hologram thus-prepared showed little light scattering and a surprisingly high diffraction efficiency of 35% when the silver image of the original amplitude hologram had a density of 2.92. For a hologram produced by converting a silver image into a silver iodide image using a conventionally known bleaching method, the diffraction efficiency was about 10% at best. Moreover, on evaluating the light stability of the hologram produced by irradiation with radiation of 150,000 lux from a high pressure mercury lamp, it was found the sample prepared in accordance with the present invention did not darken after 1 hour of exposure to the radiation, while the comparative hologram sample prepared using a prior art technique darkened in only several minutes.

EXAMPLE 2

The same procedures as described in Example 1 were repeated up to the bleaching, and then the bleached plate was rinsed with a dilute fixing solution (a concentration 1/10 of the fixing solution of Example 1) for 30 to 120 seconds whereby the surface of the silver iodide crystals in the emulsion layer was dissolved. By employing such a procedure in addition the diffraction efficiency was further increased with removal of light scattering. However, this procedure with the fixer degraded the light stability due to $Ag_2SO_3$ contamination and deposited on the crystal surface during the procedure. This drawback was averted by further immersing the photographic material into the bleaching solution described in Example 1 or in an aqueous potassium iodide solution of a concentration of about 2 weight % for several minutes whereby the contaminating $Ag_2SO_3$ or $Ag_2S_2O_3$ was removed from the surface of the silver iodide crystals. The hologram thus-prepared from an amplitude hologram with a silver image of density of 3.2 had a diffraction efficiency as high as 49%, and the light stability of the hologram was as good as in Example 1.

While the invention has been described in detail and with reference to specific embodiments thereof, it will be apparent to one skilled in the art that various changes and modifications can be made therein without departing from the spirit and scope thereof.

What is claimed is:

1. A method of preparing a bleached phase hologram comprising bleaching a silver image of an amplitude hologram formed in a silver halide photographic material by exposure of said material to an interference beam formed by superimposing an object laser beam with a reference laser beam to form said hologram and forming said silver image using conventional photographic processing, with a bleaching solution comprising a liquid medium containing iodine and comprising water and an organic liquid, said water serving to swell said colloid, said organic liquid serving to dissolve said iodine and to prevent said colloid from excessively swelling so that the gelatin and/or modified gelatin hydrophilic colloid of the silver photographic swells to an extent of from about 150 to 400%, so as to bleach said silver image by the reaction of said iodine with said silver.

2. The method of claim 1, wherein the said processing includes development and fixing said exposed silver halide photographic material.

3. The method of claim 1, wherein said organic liquid is selected from the group consisting of methanol, ethanol, isopropanol, ethylene glycol, glycerol, benzene, toluene, xylene, mesitylene, ethyl bromide, ethylene bromide, ethylene chloride, trichloroethylene, bromoform, chloroform, carbon tetrachloride, ethyl acetate, methyl acetate, diethyl ether, heptane, cyclohexane, isooctane, acetone, methyl ethyl ketone, and diethyl ketone.

4. The method of claim 1, wherein the concentration of iodine in said bleaching solution ranges from about 0.01% by weight up to a saturated solution.

5. The method of claim 1, wherein said bleaching solution comprises a mixture of an alcohol and water containing iodine at a proportion of about 100 to 500 mg of iodine and about 10 to 40 ml of water per 100 ml of the alcohol.

6. The method of claim 1, wherein said bleaching is at a temperature of about 10° C to 50° C.

* * * * *